US005666912A

United States Patent [19]

McLachlan

[11] Patent Number: 5,666,912

[45] Date of Patent: Sep. 16, 1997

[54] INTERNAL COMBUSTION ENGINE

[75] Inventor: Paul Anthony McLachlan, Christchurch, New Zealand

[73] Assignee: Pivotal Engineering Limited c/o Mace Engineering Ltd., Christchurch, New Zealand

[21] Appl. No.: 619,584

[22] PCT Filed: Sep. 16, 1994

[86] PCT No.: PCT/NZ94/00096

§ 371 Date: Mar. 15, 1996

§ 102(e) Date: Mar. 15, 1996

[87] PCT Pub. No.: WO95/08055

PCT Pub. Date: Mar. 23, 1995

[30] Foreign Application Priority Data

Sep. 16, 1993 [NZ] New Zealand ..... 248487

[51] Int. Cl.[6] ..... F02B 33/22

[52] U.S. Cl. ..... 123/65 R; 123/70 V; 123/193.6

[58] Field of Search ..... 123/193.6, 70 V, 123/65 R

[56] References Cited

U.S. PATENT DOCUMENTS

| | | | |
|---|---|---|---|
| 1,751,385 | 3/1930 | Beaudry | 123/70 V |
| 1,785,175 | 12/1930 | Belden | 123/70 V |
| 2,281,506 | 4/1942 | Kjellberg | 123/70 V |
| 2,776,650 | 1/1957 | Zimmermann | 123/70 V |
| 3,623,463 | 11/1971 | DeVries | 123/193.6 |
| 3,945,348 | 3/1976 | Balve | 123/18 R |
| 4,235,203 | 11/1980 | Thery | 123/193.6 |
| 4,457,273 | 7/1984 | Andrews | 123/193.6 |

FOREIGN PATENT DOCUMENTS

| | | |
|---|---|---|
| 64868/74 | 7/1975 | Australia . |
| 25881/77 | 12/1978 | Australia . |
| 3307714 | 9/1983 | Germany . |

*Primary Examiner*—David A. Okonsky
*Attorney, Agent, or Firm*—Popovich & Wiles, P.A.

[57] ABSTRACT

An internal combustion engine in which the piston (10) rocks about a pivot point (60) with the piston (10) being connected adjacent the end remote from the pivot point (60) to a connecting rod (12) to drive a crankshaft. The piston (10) has a first arcuate sealing surface (41) and a second arcuate sealing surface (42) which is offset radially from the first sealing surface (41) with the first and second sealing surfaces (41, 42) being connected by a floor (44). The first arcuate sealing surface (41) seals against a correspondingly arcuate wall (51) of the combustion chamber (20) and the second arcuate sealing surface (42), which forms one wall of the combustion chamber (20), seals against a wall (52) of a boost chamber (53). The engine can be compression ignition or spark ignition and can be of the two-stroke cycle or four-stroke cycle.

28 Claims, 6 Drawing Sheets

INTERNAL COMBUSTION ENGINE

This invention relates to internal combustion engines.

TECHNICAL FIELD

There are two main types of internal combustion engines, these being generally referred to as reciprocating engines and rotary engines. A reciprocating engine generally consists of a cylinder or plurality of cylinders each of which houses a reciprocating piston with the cylinder and the piston being substantially circular in cross section. Each piston is connected by means of a piston pin through a connecting rod to a crank pin which forms part of a crank shaft. Reciprocal movement of the piston consequent upon the generation of pressure within the cylinder above the piston by combustion of gases is translated to rotatory movement by the crank shaft.

Reciprocating internal combustion engines can also be classified into two main classes, the petrol/gas engine and the oil engine. With petrol/gas engines, a highly volatile fuel such as petrol or a gas derived generally from petroleum products is mixed with air, compressed and electrically ignited within the combustion chamber. Such types of engines are generally known as spark ignition engines.

An oil engine utilizes a generally non-volatile fuel and after compressing air within a combustion chamber, the fuel is injected and the temperature of the air as a result of the compression is sufficient to ignite the fuel. This type of engine is generally known as a compression ignition engine.

Each of these two classes of engines can be further subdivided into either a four stroke cycle engine or a two stroke cycle engine. While the present invention specifically relates to a two stroke cycle petrol/gas engine, the principle of construction can be applied to any of the above types of engines as will be hereinafter apparent.

BACKGROUND ART

Two stroke spark ignition engines, although they are being constantly developed are recognised as suffering from the certain disadvantages, such as:

Excessive oil consumption. This is because it is necessary to mix oil with the petrol prior to carburation or to inject the lubricating oil directly into the induction port to provide adequate lubrication to the moving parts of the engine. Because only a small proportion of the oil within the petrol/oil mixture actually reaches the areas of the engine that require lubrication, more oil than would otherwise be necessary to ensure adequate lubrication must be mixed with the petrol. Consequently two stroke engines are prone to excessive exhaust pollution through smoke.

A further disadvantage results from the usual construction whereby the intake and exhaust of gases into and out of the cylinder is arranged through ports in the cylinder wall, with the ports being successively covered and uncovered during the reciprocating movement of the piston. To obtain adequate gas flow, the ports are necessarily comparatively large in area and this presents problems in excessive wear in both the piston rings and in the skirt of the piston below the piston rings.

A yet further disadvantage with the known porting arrangements is that the gas path through the cylinder area is difficult to optimise to obtain optimum combustion.

A still further disadvantage is that to obtain satisfactory scavenging of the combustion gases, the positioning of the transfer and exhaust ports has to be arranged so that a significant portion of the incoming charge is mixed with the outgoing combusted gases and this leads to inefficiencies.

OBJECT OF THE INVENTION

It is therefore an object of this invention to provide a design of a reciprocating internal combustion engine which will minimise the above disadvantages or at least provide the public with a useful choice.

DISCLOSURE OF THE INVENTION

Accordingly one form of the invention may be said to comprise an internal combustion engine having an engine block which includes a combustion chamber, a boost chamber and a piston constrained to have rocking motion about a pivot axis within said engine block, wherein:

said piston has a first arcuate sealing surface and a second arcuate sealing surface radially offset from said first arcuate sealing surface with both said surfaces transcribing a circumferential path about said pivot axis, the said piston including a floor extending substantially radially between said first arcuate sealing surface and said second arcuate sealing surface;

said combustion chamber has four walls with two of said walls being opposite and forming opposing sides against which corresponding sides of the piston can seal, said third wall of the combustion chamber is of arcuate formation and describes a circumferential path from said pivot axis and against which said first arcuate sealing surface of the piston can seal, and said fourth wall of the combustion chamber is formed by said second arcuate sealing surface of said piston; and wherein the said second arcuate sealing surface of the piston seals the combustion chamber from the boost chamber.

In a modification, the piston may include a secondary transfer duct formed in the piston to communicate the induction chamber with the combustion chamber when the piston has rocked to a predetermined position within the combustion chamber.

In a further modification, the engine may include a poppet valve or popper valves arrangement to exhaust combustion gases from the said combustion chamber.

In a yet further modification, the engine may include a poppet valve arrangement for the inlet of a fresh charge and the exhaust of the combustion gases.

In a still further modification the boost chamber may communicate with the induction and/or combustion chamber in a manner that the rocking motion of the piston within the boost chamber will alternately draw in and expel gases within said boost chamber. The expelled gases may be ducted from the said boost chamber into said induction chamber and/or the combustion chamber.

BRIEF DESCRIPTION OF THE DRAWINGS

A preferred form of the invention will now be described with the aid of the accompanying drawings wherein.

BEST MODE OF CARRYING OUT THE INVENTION

Figure 1:
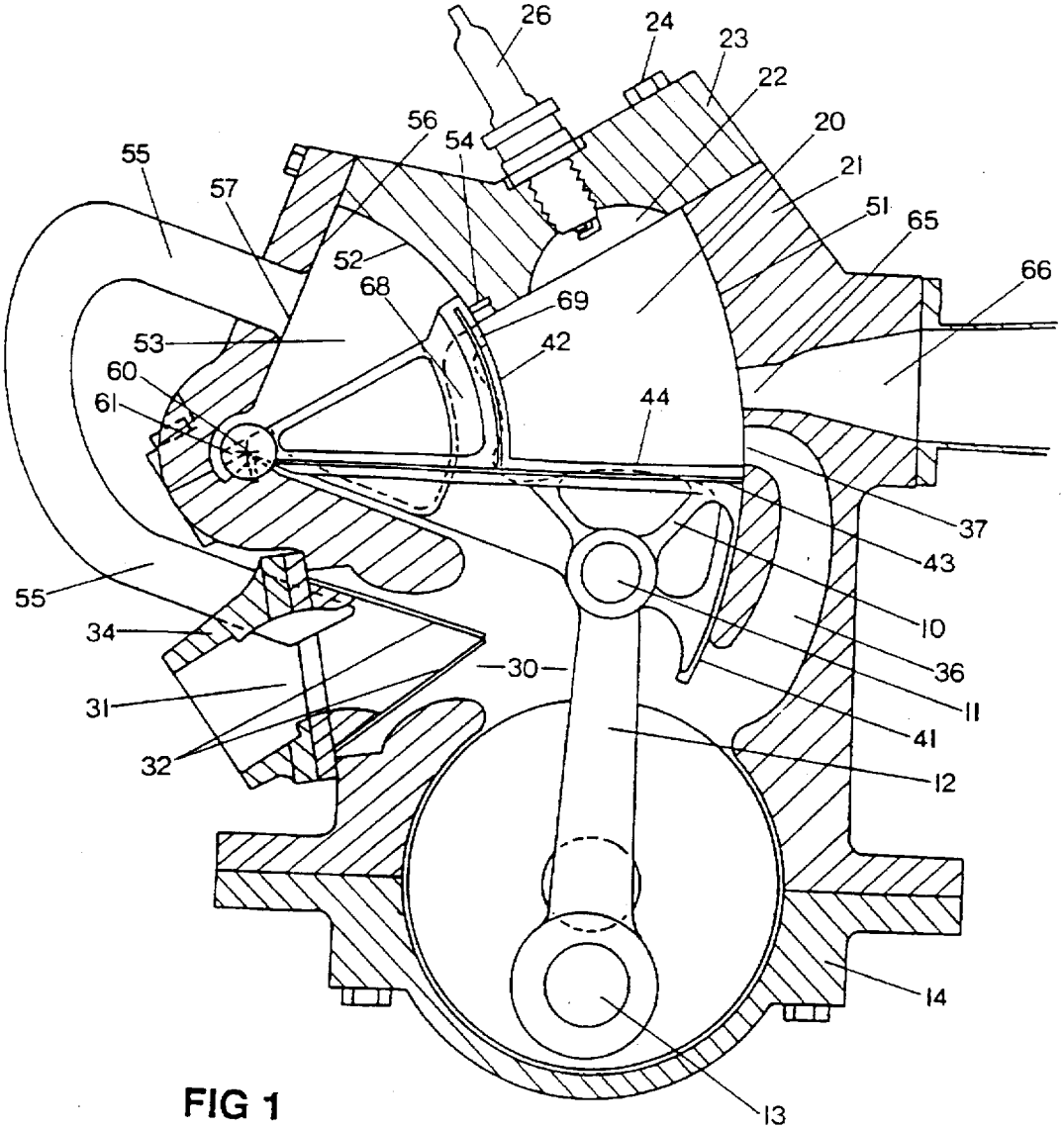
FIG. 1 is a partly diagrammatic cross-sectional view of the engine showing the piston at the bottom dead centre position.
Figure 2:
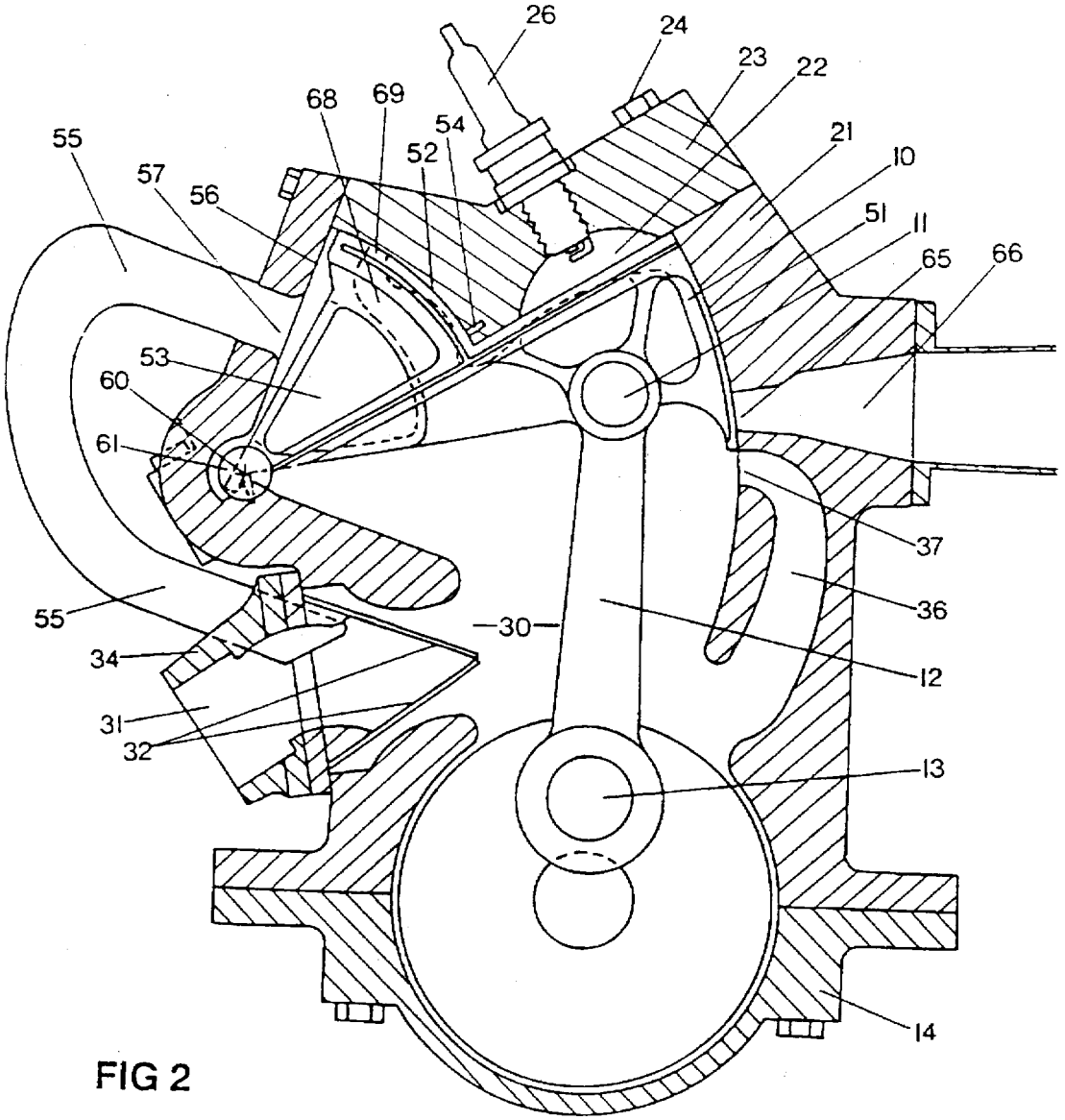
FIG. 2 is a similar view to that shown in FIG. 1 but with the piston at the top dead centre position.

In describing the preferred mode of the invention, reference will be made to the form of the invention wherein it is configured to a two stroke spark ignition engine with the inlet and outlet ports being formed in the wall of the combustion chamber. As will be seen from the following description, while this is the preferred configuration, an engine using the piston arrangement of this invention can be configured into either a compression ignition or a spark ignition engine. As can be seen from the drawings, the piston 10 is provided with a suitable piston pin 11 to receive an end of a connecting rod 12, the other end of which is journalled to a crank pin 13 of a crank shaft which is suitably journalled within a crank case 14 which forms part of an engine block 21. A removable head 23 is suitably attached to the block 21 such as by studs 24 which pass into the engine block 21. The combustion chamber 20 may include a hemispherical or other shaped cavity 22 formed in the head 23 and is provided with ignition means such as the spark plug indicated at 26.

An inlet 31 which may be provided with a reed or other suitable valve 32 ducts the fuel/air mixture from the carburettor (not shown in the drawings) to the induction chamber 30 which forms part of the interior of the crankcase of the engine block 21. The inlet 31 may have suitable connecting means such as an internal thread to receive and retain an inlet duct adapter 34 so that an air/fuel mixture can be admitted to the induction chamber 30. The induction chamber also includes a primary transfer duct 36 which communicates the induction chamber 30 with the combustion chamber 20. The primary transfer duct 36 terminates in a transfer port 37 in the wall of the combustion chamber 20 to enable pressurized air/fuel mixture to pass from the induction chamber 30 into the combustion chamber 20 when the piston has uncovered the transfer port 37 as will be hereinafter further described.

Figure 3:
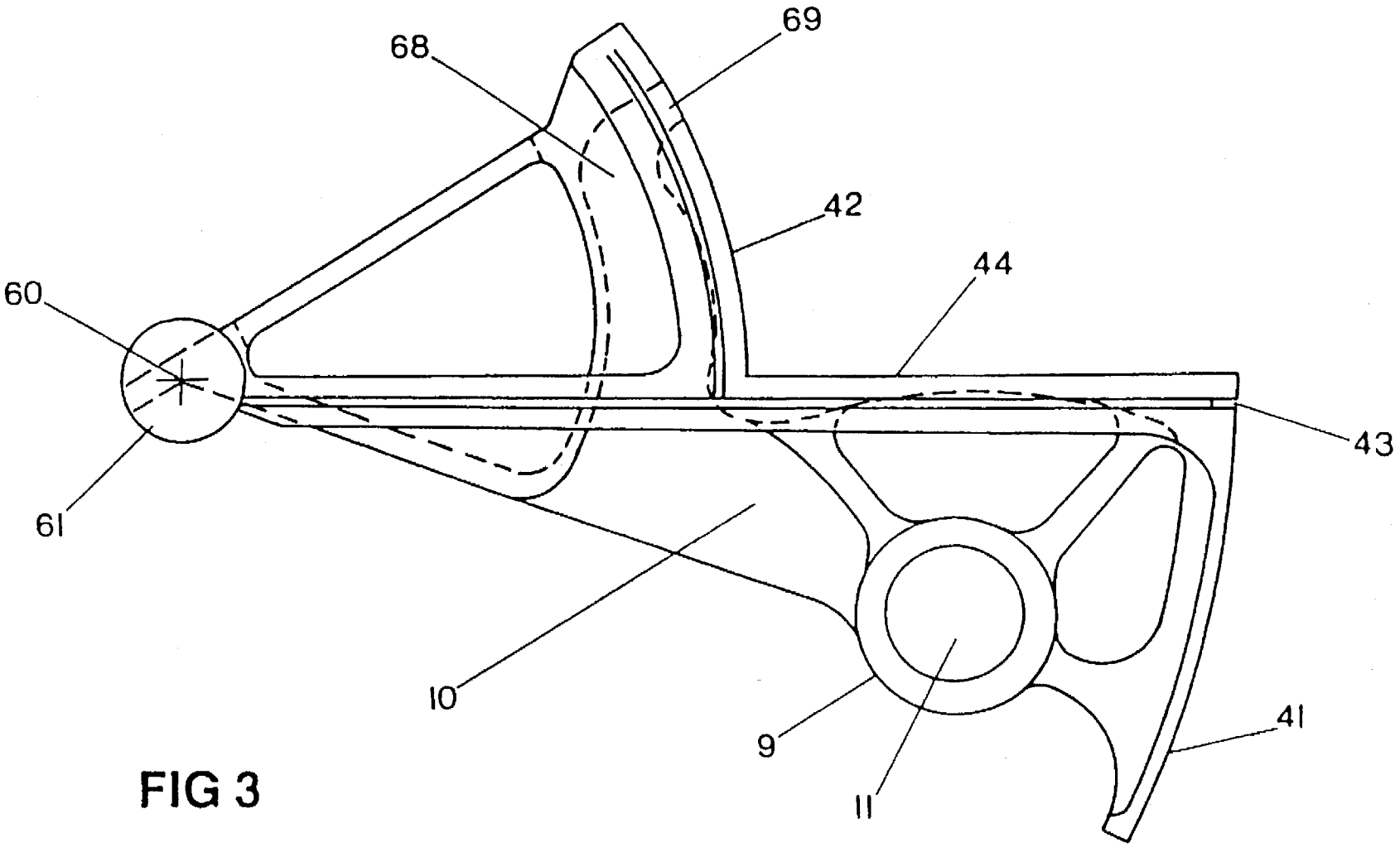
FIG. 3 is a partly diagrammatic side view of a suitable construction of a piston such as that indicated in FIGS. 1 and 2.

As shown particularly in FIG. 3, the piston has an arcuate first sealing surface 41 and an arcuate second sealing surface 42 which is radially offset from the arcuate first sealing surface 41. Both the sealing surfaces 41 and 42 describe a circumferential path about a common pivot axis 60. The first sealing surface 41 has a suitable sealing groove 43 to receive sealing means (not shown in the drawings) so that the arcuate first sealing surface 41 can be gas sealed against the correspondingly arcuate wall 51 of the combustion chamber 20 during movement of the piston. The arcuate second sealing surface 42 is also adapted to be gas sealed against the correspondingly arcuate wall 52 of a boost chamber 53 by means of a groove 54 formed in the wall 52 into which is situate suitable sealing means to provide the gas seal against the said arcuate second sealing surface 42. The piston also includes a floor 44 which extends between the arcuate sealing surfaces 41 and 42. In a highly preferred form, the floor will form a surface which lies substantially radial to the pivot axis 60 of the piston. As shown in the drawings, the floor 44 forms a planar surface, but this can be crowned or concave or of other suitable shape as required. While it is preferred the surface of the floor 44 lie on a line which is substantially radial to the pivot axis 60, the surface can lie on a line which is at an angle to the radius.

The piston 10 is constrained to have a rocking motion within the combustion chamber 20 by means of a pivot axis 60 which consists of a suitable bearing in conjunction with a pivot pin 61 suitably housed within the chamber walls which forms part of the engine block 21. The pivot axis 60 may include suitable sealing such as a seal which bears onto the axis line of the piston (not shown in the drawings) so that the induction chamber 30 is sealed from the boost chamber during the rocking movement of the piston 10. Other forms of sealing between the two chambers may also be utilized as is known in the art, one such method being for instance a scraping seal positioned distal from the pivot 60. In addition to the sealing means at the arcuate sealing surfaces and at or adjacent the pivot axis, suitable scraping sealing means as is known in the art is provided between the sides of the piston and the combustion chamber walls contiguous to the sides of the piston.

Figure 4:
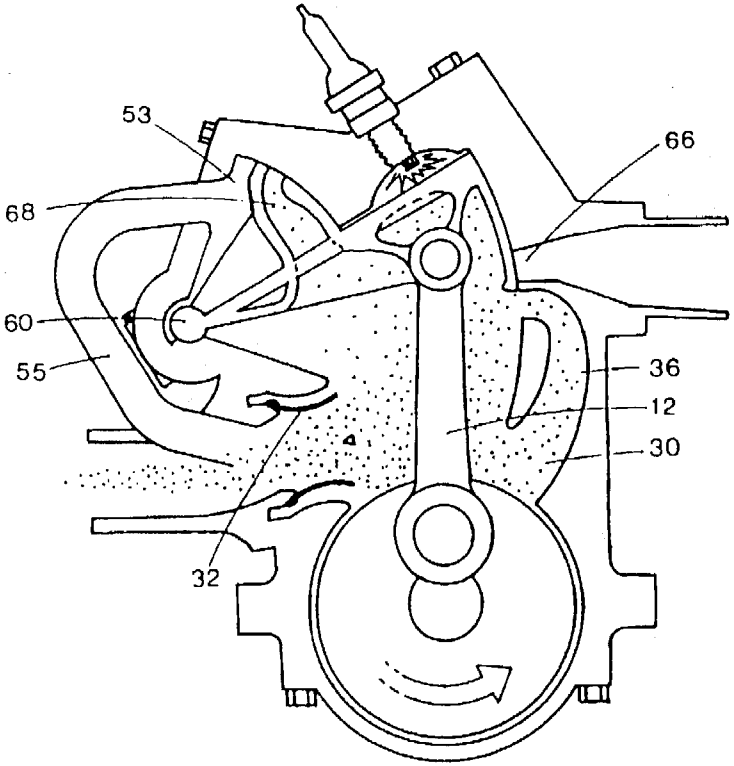
FIG. 4 is a diagrammatic view of the engine at the top dead centre position.

The arcuate sealing surfaces 41 and 42 each have a constant radial dimension from the pivot point 60. When the piston 10 is at the bottom dead centre position as indicated in FIG. 1, the transfer port 37 is opened to the combustion chamber 20 so that pressurized fuel/air mixture can pass from the induction chamber 30 into the combustion chamber 20. FIG. 4 indicates diagrammatically the stage of the engine immediately at the top dead centre position where ignition of the compressed fuel/air mixture has just occurred. At this point, the reed valve 32 is still open and the induction chamber 30 is filling-with a fresh charge and the induction chamber 30 is sealed from the exhaust port by the piston surface 41. The force of the combustion will react on the piston to drive it and the connecting rod downwardly and so rotate the crankshaft in an anticlockwise direction as indicated by the arrow-in the drawings.

Figure 5:
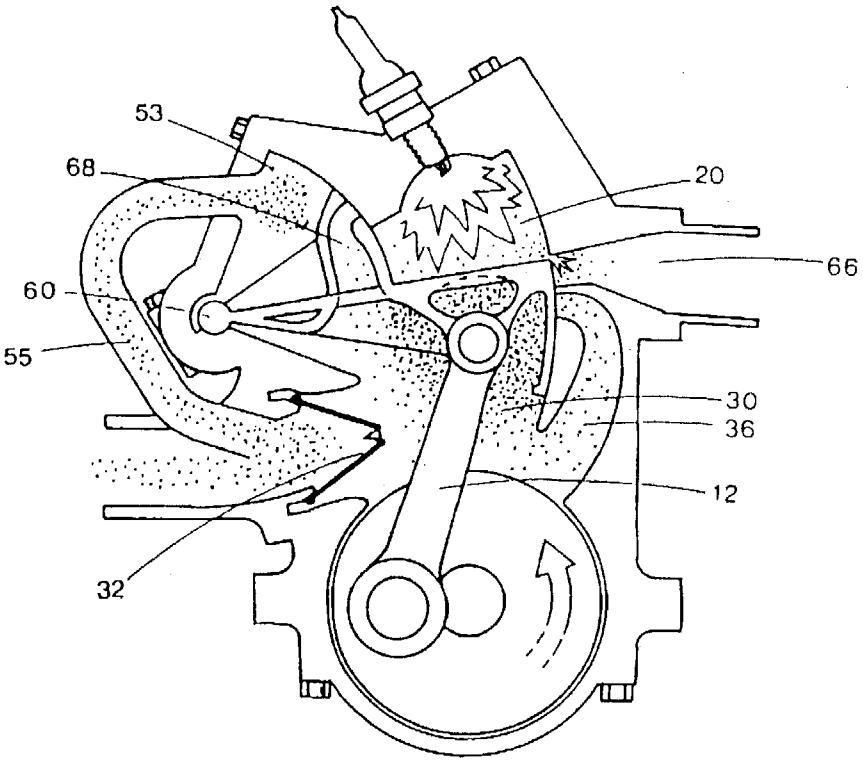
FIG. 5 is a diagrammatic view of the engine after ignition with the exhaust port opening.

FIG. 5 indicates the state of the engine at approximately 95° after top dead centre and at this stage the exhaust port 65 is commencing to open and the fresh charge within the induction chamber 30 is beginning to compress. The reed valve 32 is closed.

Figure 6:
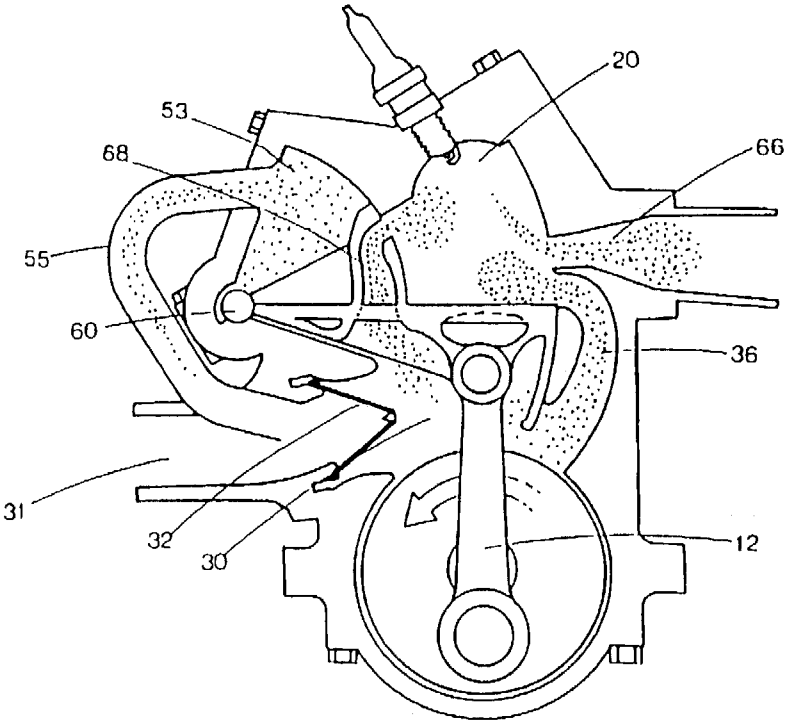
FIG. 6 is a diagrammatic view of the engine at bottom dead centre with the exhaust gases being expelled.

FIG. 6 indicates the state of the engine at approximately bottom dead centre. At this stage, the exhaust gases have been expelled out of the exhaust port 65 and through the exhaust outlet 66. The fresh charge is commencing to fall the combustion chamber 20 through the primary transfer duct 36 and the transfer port 37. The reed valve 32 is still closed.

Figure 7:
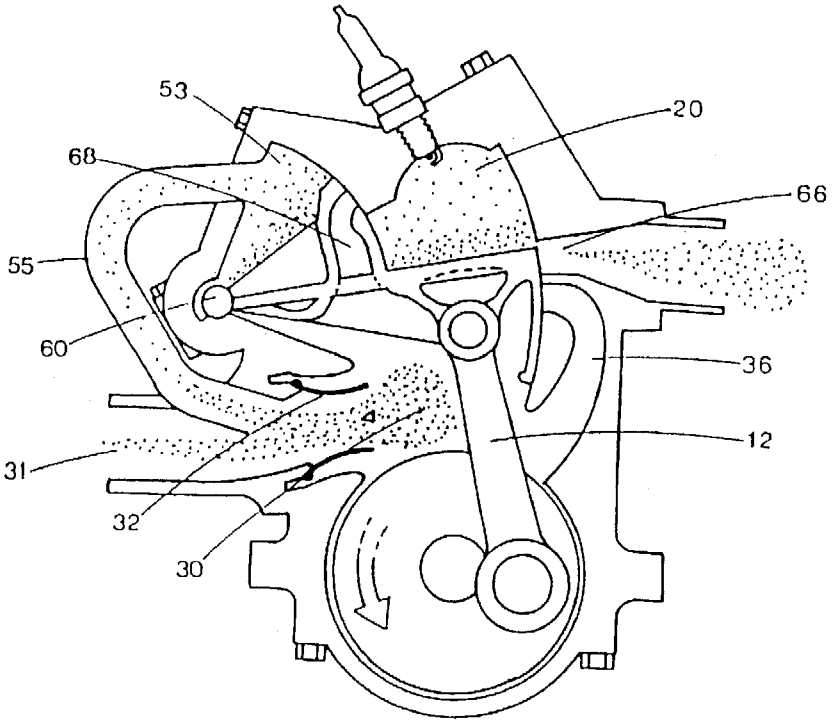
FIG. 7 is a diagrammatic view of the engine before top dead centre with the exhaust port closing.

FIG. 7 indicates the compression stroke in which the charge in the combustion chamber is being compressed and the combustion chamber is being scavenged. The transfer port is closed to the induction chamber which is beginning to draw a fresh charge through the now open reed valve 32 from the inlet 31. During this cycle, suitable scavenging of the spent charge is achieved by the appropriate positioning of the transfer and exhaust ports.

As can be seen from the drawings, the piston also preferably includes an additional transfer port formed within the body of the piston. One preferred form of the port is a secondary transfer duct 68 which is open on the crankshaft side of the piston to the induction chamber 30. The secondary transfer duct 68 exits through the arcuate second sealing surface 42 to form the secondary transfer port 69 (see particularly FIG. 3). When the piston is adjacent the bottom dead centre as shown in FIG. 1 the secondary transfer port 69 and the duct 68 will therefore communicate the induction chamber 30 with the combustion chamber 20. This double induction into the combustion chamber will assist in setting up a swirl effect to the air/fuel charge within the combustion chamber. In prior known forms of porting it was necessary for the transfer ports to be at an oblique angle, but the transfer ports of the present invention will provide optimum filling of the combustion chamber 20 because of the direct flow of the charge into the combustion chamber 20. In addition, because the fresh charge is transferred simultaneously through the transfer ports at diagonally opposed comers of the combustion chamber 20, the distance which the fresh charge must travel to fill the combustion chamber is minimised and consequently the control of the distance and the control of the gas flow direction will assist in retaining a clean charge in the combustion chamber.

It will also be evident from the drawings that the positioning of the exhaust port on the outer radial wall 51 of the combustion chamber provides a superior swept area and it is therefore possible to obtain an optimum exhaust port opening prior to the opening of the transfer ports. Consequently, in combination with a combustion chamber which can be wide across the porting walls, that is in line with the piston pin, a considerable improvement in effective porting area can be obtained.

Because of the comparatively straight nature of the exhaust port 65, it is possible to provide effective variable timing mechanism for the exhaust port.

The engine also includes a chamber 53 formed by the wall 52 which is in sealing contact with the second sealing surface 42, with the remainder of the chamber being formed by suitable side walls and a head wall 56 which includes a port 57. As can be seen from the drawings, in the highly preferred form of the engine, the wall 52 of the boost chamber is shaped to describe a circumferential path having the pivot point 61 as its axis. During the rocking movement of the piston, ambient air will be drawn into and expelled from the chamber 53 through the port 57. The chamber 53 and its port 57 can also be utilised as a boost chamber by connecting the port through a duct 55 to the inlet 31 upstream of the reed valve 32. During reciprocation of the piston, a fuel air mixture can then be drawn into the boost chamber and exhausted through the port 57 into the inlet 31. While the boost chamber may or may not be utilised in this manner as required, the provision of the boost chamber as such is necessary to allow the piston to operate in the manner described. If the boost chamber is not connected to the inlet 31, it is highly desirable that means be provided to minimise the entry of dirt and other debris into the boost chamber. Any such means as will be apparent to those skilled in the art can be employed for this purpose.

In a modification of the form of the boost chamber, the wall 52 of the boost chamber does not describe a circumferential path from the pivot point 61. In this modification, the sealing means is not formed in the arcuate sealing surface 42 and instead a suitable line seal is formed within the boost chamber against which the arcuate sealing surface 42 of the piston will seal. It will of course be understood that depending upon the positioning of the line seal and on the specific requirements, the piston will not include the secondary transfer duct 68.

The particular operation of the boost chamber of the preferred form of the will now be described in conjunction with the diagrammatic representations in FIGS. 4 through 7. In FIG. 4, the fresh charge in the boost chamber 53 has been exhausted through the duct 55, past the open reed valve 32 into the induction chamber 30 and ignition has just occurred. As shown in FIG. 5, as the piston is being forced downwardly by the combustion process, the reed valve 32 is closed and the boost chamber 53 is being filled with a fresh charge by reason of the duct 55 communicating with the inlet 31. During the period when the engine is rotating to the bottom dead centre position indicated in FIG. 6, the boost chamber will continue to be filled with a fresh charge which consists of air/fuel mixture from the carburettor. After the engine has rotated past the bottom dead centre position as indicated in FIG. 7, the induction chamber will be subjected to a negative pressure which will open the reed valve and fuel/air mixture will commence to flow into the induction chamber from the inlet 31. At the same time, the charge in the boost chamber 53 will be discharged through the duct 55 and will augment the charge passing from the carburettor through the now open reed valve into the induction chamber 30.

This augmentation will enable the carburettor to function efficiently since it is possible because of the out of phase action of the boost chamber, to obtain a more even flow of gases through the carburettor than was previously possible.

Particular advantages exhibited by the engine herein described is that because the piston is pivoted, the thrust load exerted by the piston against the chamber wall is minimised. In addition, the load on the piston pivot created by the load exerted onto the angled connecting rod is largely counteracted by the force exerted onto that pan of the piston which constitutes the inner radial wall of the combustion chamber. Further the absence of a requirement for the chamber wall to retain the piston reduces the extent of lubrication necessary with prior known forms of pistons. The bearings and seals may be directly fed by metered lubrication, making it possible to very considerably reduce the amount of oil consumption over that currently required by reciprocating two stroke engines.

Because of the absence of a surrounding piston skin and because of the multi functional nature of the piston, very adequate cooling of the piston can be obtained and the flow of the fresh charge across the underside of the piston crown area and through the piston transfer porting increases the potential work rate of the piston before overheating of the piston crown can occur.

Particularly when utilising the chamber 53 as a boost chamber, it is possible to obtain high speed filling of the induction chamber 30 because the boost chamber operates in reverse to the induction chamber 30 so that the push-pull effect on the reed valve will ensure a maximum charge is drawn into the induction chamber at high speed.

A further advantage exhibited by the design of the present engine is that the radial path described by the piston pin creates a preferred crankshaft rotation direction enabling optimum piston acceleration and the creation of mechanical leverage and drive to the crankshaft at an early stage of the power stroke. Furthermore the radial path of the piston pin will place the piston pin in an off set position in relation to the top dead centre and bottom dead centre line of the crankshaft at the point where the piston uncovers the exhaust port. This creates an "early open, early dose" effect on the exhaust port timing while still maintaining a 180° separation between top dead centre and bottom dead centre. This effect extends to the timing in degrees between the exhaust port opening and the transfer port opening as compared to the transfer port closing and exhaust port closing.

A yet further advantage exhibited by the engine of the present invention is that the greater swept area of the induction chamber 30 over the swept area of the combustion chamber 20 will facilitate the transfer of the fresh charge and will assist in the optimum filling of the combustion chamber, particularly when the engine is operating at a high speed.

Figure 8:
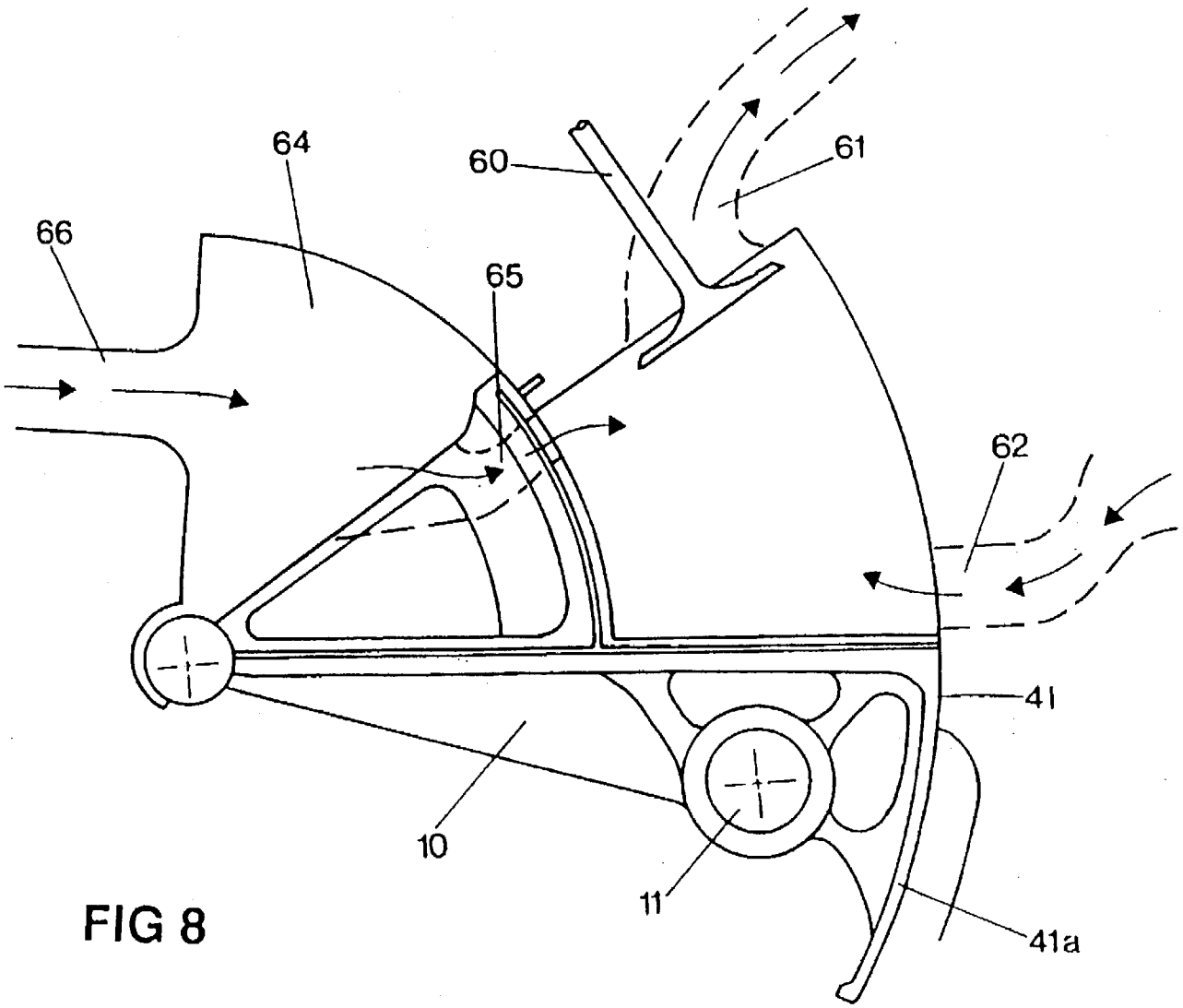
FIG. 8 is a diagrammatic view of an arrangement utilising a poppet valve to control the exhaust of the combustion gases.

While in the forgoing description, the construction has been described specifically in relation to a two stroke spark ignition engine which utilizes a transfer port in the chamber wall and a transfer port in the piston in conjunction with an exhaust port also in the chamber wall, it is to be understood that this is one preferred embodiment only. As shown in FIG. 8, the engine may include a poppet valve or valves 60 in conjunction with an exhaust port 61 for controlling the exhaust of combustion gases in a two stroke compression ignition or spark ignition engine. In this arrangement, the inlet port 62 which is formed in the wall of the combustion chamber may be connected through suitable ducting to a source of fuel/air mixture. Similarly the boost chamber 64 can also be connected through the port 65 formed in the piston 10 to the combustion chamber. The chamber 64 is also provided with duct 66 for connection to a fuel/air supply which may be the same or different supply to that feeding the inlet port 62. The fuel air supply can be normally aspirated or can be forced aspiration through a suitable compressor as is known in the art.

In a yet further modification, the inlet port in the combustion chamber and the port in the piston can be dispensed with and a known form of inlet and exhaust popper valve arrangement can be used. In this modification, the part of the arcuate sealing surface 41 which forms a skirt 41*a* (see FIG. 8) can either be dispensed with or considerably reduced in size. It will also be understood that any of the configurations can work satisfactorily, with suitable modifications, as a compression ignition engine.

Modifications and improvements to the preferred forms of the invention as disclosed and described herein may occur to those skilled in the art and who come to understand the principles and precepts of the invention. All such modifications and improvements are intended to be included in the scope of this invention which is not to be limited to the embodiments herein described only by the advance by which the invention has promoted the art and as claimed in the appended claims.

I claim:

1. An internal combustion engine unit having an engine block which includes a single combustion chamber and a single piston constrained to have rocking motion about a pivot axis within said engine block, wherein:

said piston has a first arcuate sealing surface and a second arcuate sealing surface radially offset from said first arcuate sealing surface with both said surfaces transcribing a circumferential path about said pivot axis, the piston including a floor extending substantially radially between said first arcuate sealing surface and said second arcuate sealing surface;

said combustion chamber has four walls;

one wall of the combustion chamber is of arcuate formation and describes a circumferential path from said pivot axis and against which said first arcuate sealing surface of the piston can seal;

and another wail of the combustion chamber is formed by said second arcuate sealing surface of said piston.

2. The internal combustion engine unit of claim 1, wherein an inlet transfer port and an exhaust port is formed in a second wall of the combustion chamber, said inlet transfer port communicating via a transfer duct with an induction chamber below said piston and wherein means are provided to charge said induction chamber with a fuel/air mixture and wherein said exhaust port communicates with an exhaust outlet.

3. The internal combustion engine unit of claim 2, wherein an induction chamber situated below the piston communicates with the combustion chamber via a primary transfer duct when the inlet transfer port is uncovered by the piston.

4. The internal combustion engine unit of claim 2, wherein the exhaust port in the one wall of the combustion chamber communicates with the combustion chamber when the exhaust port is uncovered by the piston.

5. The internal combustion engine unit of claim 3, wherein a secondary transfer duct is formed in the piston to allow the induction chamber to communicate with the combustion chamber when the piston has rocked to a predetermined position within the combustion chamber.

6. The internal combustion engine unit of claim 1, wherein the first arcuate sealing surface includes a sealing groove to receive a seal adapted to seal against the one wall of the combustion chamber.

7. The internal combustion engine unit of claim 1 which further includes a boost chamber, the boost chamber sealed from the combustion chamber by the second arcuate sealing surface of the piston.

8. An internal combustion engine unit including an engine block which has a single combustion chamber, a boost chamber and a single piston constrained to have rocking motion about a pivot axis within said engine block, wherein:

said piston has a first arcuate sealing surface and a second arcuate sealing surface radially offset from said first arcuate sealing surface with both said surfaces transcribing a circumferential path about said pivot axis, the piston including a floor extending substantially radially between said first arcuate sealing surface and said second arcuate sealing surface;

said combustion chamber has four walls;

one wall of the combustion chamber being of arcuate formation which describes a circumferential path from said pivot axis and against which said first arcuate sealing surface of the piston can seal;

and another wall of the combustion chamber being formed by said second arcuate sealing surface of said piston;

the second arcuate sealing surface of the piston seals the combustion chamber from the boost chamber and wherein a primary transfer duct provides communication between an induction chamber situated below the piston and the combustion chamber through a port in the one wall of the combustion chamber which is uncovered by the piston when the piston has reached a predetermined position within the combustion chamber to enable an air/fuel charge to pass from the induction chamber into the combustion chamber, an exhaust port in the one wall of the combustion chamber adapted to be uncovered by the piston when the piston has reached a predetermined position within the combustion chamber whereby combustion gases can exit the combustion chamber.

9. The internal combustion engine unit as claimed in claim 1, wherein the boost chamber includes an arcuate wall which describes a circumferential path from said pivot axis and wherein said wall includes a seal adapted to seal against the second arcuate sealing surface of the piston.

10. The internal combustion engine unit of claim 1, which includes an inlet port adapted to transfer a fuel/air mixture to the combustion chamber by a poppet valve arrangement.

11. The internal combustion engine unit of claim 1, which includes an exhaust outlet which communicates through an exhaust port to the combustion chamber by means of a poppet valve arrangement.

12. The internal combustion engine unit of claim 1, wherein the boost chamber is connected through a duct to an inlet which communicates with an induction chamber situated within the engine block and below said piston.

13. The internal combustion engine unit of claim 12, wherein a reed valve controls communication between the inlet and the induction chamber.

14. The internal combustion engine unit of claim 7, wherein the boost chamber includes a wall which can seal against the second arcuate sealing surface of the piston.

15. An internal combustion engine unit having: a) a single combustion chamber, b) a single piston pivoted on a pivot and forming part of the combustion chamber, c) a transfer port to admit a gaseous charge into the combustion chamber, d) an exhaust port to exhaust gas from the combustion chamber, and e) a connection between the piston and a crankshaft, wherein:

the piston has a first arcuate surface and a second arcuate surface radially offset from said first arcuate surface with both said surfaces transcribing a circumferential path about the piston pivot, the piston including a floor extending substantially radially between the first arcuate surface and the second arcuate surface;

the combustion chamber is formed by walls, a first wall being of arcuate formation and describing a circumferential path from said piston pivot and against which the first arcuate surface of the piston can seal; and a second wall of the combustion chamber being of arcuate formation and describing a circumferential path from said piston pivot and against which the second arcuate surface of the piston can seal.

16. The internal combustion engine unit of claim 15 which further includes a boost chamber, the boost chamber isolated from the combustion chamber by the second arcuate surface of the piston.

17. The internal combustion engine unit of claim 15, wherein the transfer port and the exhaust port are formed in the first wall of the combustion chamber.

18. The internal combustion engine unit of claim 17, wherein the crankshaft is located in an induction chamber situated below the piston, an induction chamber inlet is provided to enable the induction chamber to be charged with gaseous material, and a transfer duct provides communication between the induction chamber and the transfer port.

19. The internal combustion engine unit of claim 18, wherein the induction chamber commnunicates with the combustion chamber when the transfer port is uncovered by the piston.

20. The internal combustion engine unit of claim 17, wherein the exhaust port in the wall of the combustion chamber communicates with the combustion chamber when the exhaust port is uncovered by the said piston.

21. The internal combustion engine unit of claim 18, wherein a secondary transfer duct is formed in the piston to provide communication between the induction chamber and the combustion chamber when the piston has pivoted to a predetermined position within the combustion chamber.

22. The internal combustion engine unit of claim 15, wherein the said first arcuate surface of the piston includes a sealing groove to receive a seal adapted to seal against the arcuate wall of the combustion chamber.

23. The internal combustion engine unit of claim 16, wherein the boost chamber includes a wall which includes a seal to seal against the said second arcuate surface of the piston.

24. An internal combustion engine unit which includes:

a) a single combustion chamber, b) a boost chamber, and c) a single piston pivoted about a pivot axis and connected to a crankshaft housed within an induction chamber situated below the piston, wherein:

i) an exhaust port and a transfer port are formed in a wall of the combustion chamber and are each adapted to be alternately sealed from the combustion chamber and opened to the combustion chamber by the piston when the piston has reached a predetermined position within the combustion chamber, ii) the piston has a first arcuate surface and a second arcuate surface radially offset from said first arcuate sealing surface with both said surfaces transcribing a circumferential path about said pivot axis, the piston including a floor extending substantially radially between said first arcuate surface and said second arcuate surface; and iii) the combustion chamber has walls, one wall being of arcuate formation which describes a circumferential path from said pivot axis and against which said first arcuate surface of the piston can seal and another wall being of arcuate formation which describes a circumferential path from said pivot axis and against which said second arcuate surface of said piston can seal in a manner such that a seal is maintained between the combustion chamber and the boost chamber.

25. The internal combustion engine unit of claim 24, wherein the interior of the boost chamber communicates via a duct with an inlet to the induction chamber.

26. The internal combustion engine unit of claim 25, wherein a reed valve controls the communication between the inlet to the induction chamber and the induction chamber.

27. The internal combustion engine unit of claim 15 including a transfer port adapted to transfer a fuel/air mixture to the combustion chamber by a poppet valve arrangement.

28. The internal combustion engine of claim 15, including an exhaust outlet which communicates through an exhaust port to the combustion chamber by means of a poppet valve arrangement.

* * * * *

UNITED STATES PATENT AND TRADEMARK OFFICE

CERTIFICATE OF CORRECTION

PATENT NO. : 5,666,912

DATED : September 16, 1997

INVENTOR(S) : Paul Anthony McLachlan

It is certified that error appears in the above-indentified patent and that said Letters Patent is hereby corrected as shown below:

Column 2, line 44, replace "popper" with --poppet--;

Column 4, line 40, remove the hyphen after "arrow";

Column 4, line 49, replace "fall" with --fill--;

Column 5, line 13, replace "comers" with --corners--;

Column 6, line 29, replace "pan" with --part--;

Column 6, line 38, replace "skin" with --skirt--;

Column 6, line 60, replace "dose" with --close--;

Column 7, line 27, replace "popper" with --poppet--; and

Column 7, line 60, replace "wail" with --wall--.

Signed and Sealed this

Third Day of February, 1998

Bruce Lehman

BRUCE LEHMAN

*Commissioner of Patents and Trademarks*

*Attest:*

*Attesting Officer*